US005601360A

United States Patent [19]

Paquette

[11] Patent Number: 5,601,360

[45] Date of Patent: Feb. 11, 1997

[54] PLUG-IN ELECTRICAL CANDLE FOR A WINDOW SILL

[76] Inventor: James G. Paquette, 2235 Conowingo Rd., Bel Air, Md. 21015

[21] Appl. No.: 657,587

[22] Filed: Jun. 7, 1996

[51] Int. Cl.[6] ..... H01R 33/00

[52] U.S. Cl. ..... 362/226; 362/183; 362/392; 362/810

[58] Field of Search ..... 362/125, 183, 362/190, 191, 253, 226, 392, 393, 145, 810

[56] References Cited

U.S. PATENT DOCUMENTS

| | | | |
|---|---|---|---|
| D. 31,044 | 6/1899 | Perkins . | |
| D. 51,893 | 3/1918 | Temple et al. . | |
| D. 151,571 | 10/1948 | Tillinghast | D26/1 |
| 1,677,412 | 7/1928 | Smith . | |
| 2,499,731 | 3/1950 | Derington | 40/130 |
| 2,629,761 | 2/1953 | Determan | 173/330 |
| 3,182,185 | 5/1965 | Ahroni et al. | 240/10 |
| 3,286,088 | 11/1966 | Ahroni | 240/10 |
| 3,400,359 | 9/1968 | Bedini | 339/25 |
| 4,462,066 | 7/1984 | Gibson et al. | 362/251 |
| 4,468,721 | 8/1984 | Vandrilla | 362/392 |
| 4,676,570 | 6/1987 | Pincherri | 439/148 |
| 4,744,014 | 5/1988 | Harris | 362/145 |
| 4,764,853 | 8/1988 | Thomas et al. | 362/392 X |
| 4,821,158 | 4/1989 | Mitten | 362/125 X |
| 4,839,784 | 6/1989 | Lin | 362/393 |
| 5,124,903 | 6/1992 | Coviello | 362/392 |
| 5,199,781 | 4/1993 | Sweeny | 362/145 |
| 5,205,641 | 4/1993 | Albrecht | 362/226 |
| 5,329,437 | 7/1994 | Briggs | 362/393 |
| 5,331,529 | 7/1994 | Huang | 362/226 |

*Primary Examiner*—Stephen F. Husar
*Attorney, Agent, or Firm*—Leonard Bloom

[57] ABSTRACT

In combination with a low-voltage socket installed in a window sill, an electric candle has a low-voltage bulb at the top and a pair of prongs at the bottom. These prongs engage the contacts provided in the socket when the candle is slipped therein. The socket thus also stabilizes the candle light, mechanically, and prevents the candle light from tipping over. A decorative base may be slipped over the candle (above the socket). When the candle light is not being used, it may be lifted out of the receptacle; and thereafter, a protective cap may be pressed over the receptacle for closure purposes.

24 Claims, 11 Drawing Sheets

10
14
11
38
31
18'
18'
31
22
21
34
26

10
38
26

10
40
36
21

40
34
26

PLUG-IN ELECTRICAL CANDLE FOR A WINDOW SILL

CROSS REFERENCE TO RELATED APPLICATIONS (Not Applicable.)

STATEMENT REGARDING FEDERALLY SPONSORED RESEARCH OR DEVELOPMENT (Not Applicable.)

REFERENCE TO A MICROFICHE APPENDIX SPECIFYING THE TOTAL NUMBER OF MICROFICHE AND TOTAL NUMBER OF FRAMES (Not applicable.)

BACKGROUND OF THE INVENTION

The present invention relates to replaceable low-voltage window candles for Christmas and other holidays.

It is a tradition to decorate windows with candles during the holidays as Christmas, Hanukkah, Halloween, and so on. Nowadays, the wax candles are replaced with electric candles available and sold in abundant variety.

Electric candles are usually installed in window sills and are held therein by holders as described, for instance, in U.S. Pat. Nos. 4,468,721 and 5,199,781 or they are taped down to prevent them from falling over. The electric cords lead from the candles (along the walls and the floor) to 120 V electric receptacles. Sometimes, additional wiring is needed to reach candles installed in more than one window. These cords are required all over the place, which is inconvenient and may cause unsafe situations.

Builders are now putting the receptacles just below the window sill (and centered with respect to the window) but a cord is still required.

Battery operated individual lights are not a practical solution since the batteries are fully discharged in a relatively short time period.

As an intended improvement to the art, U.S. Pat. No. 5,329,437 discloses a cordless electric candle system in which a candle may be retracted for storage into the wall space below a window sill and may be raised into view for use.

The present invention is a substantial improvement and alleviates the disadvantages and deficiencies of the prior art.

BRIEF SUMMARY OF THE INVENTION

It is, therefore, an object of the present invention to provide a safe and convenient replaceable electric candle for plugging into the window sill, when needed or desired, and for being easily unplugged.

According to the teachings of the present invention, a replaceable electric candle includes a cylindrical (or tubular) body, and a low-voltage bulb is removably secured at the top of the tubular body. A pair of prongs are secured to the lower portion of the tubular body, and a suitable conductive means (such as wires) are disposed within the tubular body and electrically connect the pair of prongs with the low-voltage bulb. If desired, a decorative sleeve is slipped over the tubular body of the electric candle.

In a preferred embodiment, a low-voltage socket is installed in a window sill. Preferably, the socket includes a hollow cylindrical body having a receptacle end coinciding with the upper surface of the window sill and further having a contact end. A pair of electric contacts are provided at the contact end.

When the electric candle is being used, the bottom of the decorative sleeve leans against the receptacle end of the cylindrical body of the socket; and the lower portion of the tubular body of the electric candle is received within the cylindrical body of the socket such that each of the pair of prongs engages a respective one of the pair of electric contacts at the contact end of the cylindrical body of the socket, thereby supplying electric power to the low-voltage bulb and mechanically stabilizing the electric candle within the socket. When not being used, the electric candle is lifted out of the socket.

Preferably, when the electric candle is lifted out of the socket, a protective cap is pressed over the socket.

There are two preferred embodiments of the present invention. According to one embodiment, the prongs are secured to a lowermost surface of the lower part of the tubular body and are substantially parallel with a longitudinal axis thereof.

In the other embodiment, the prongs are horizontally extended from the tubular body of the electric candle, above the lowermost surface of the tubular body. Preferably, the prongs are spaced 180° from each other horizontally, and the prongs are spaced vertically. To comply with this embodiment of the electric candle, the cylindrical body of the socket includes a pair of internal side vertical slots spaced 180° from each other. Each slot terminates in a respective horizontal slot positioned at the contact end. Each of these horizontal slots accommodates an electric contact. Preferably, the horizontal slots are spaced vertically, such that when the electric candle is to be inserted into the socket, the prongs are to be moved down along the vertical slots until they engage the horizontal slots; and thereafter, the electric candle is rotated, each prong within a respective horizontal slot approximately ¼ turn, until each prong engages a respective one of said electric contacts.

Preferably, the receptacle end of the cylindrical body of the socket has a flange having an upper surface rising slightly above the upper surface of the window sill. The bottom surface of the decorative sleeve is shaped similar to the upper surface of the flange.

The decorative sleeve may be made of brass or a plastic. Preferably, the plastic is flashed to have a metal-like appearance. In lieu of a decorative sleeve, a decorative collar or a base may be used, the height of positioning of which is adjusted along the tubular body of the electric candle.

The electric contacts are terminals of a parallel 12 V circuit operated through a step-down transformer. The electric candle may include a back-up rechargeable battery.

These and other objects of the present invention will become apparent from a reading of the following specification taken in conjunction with the enclosed drawings.

DESCRIPTION

Figure 1:
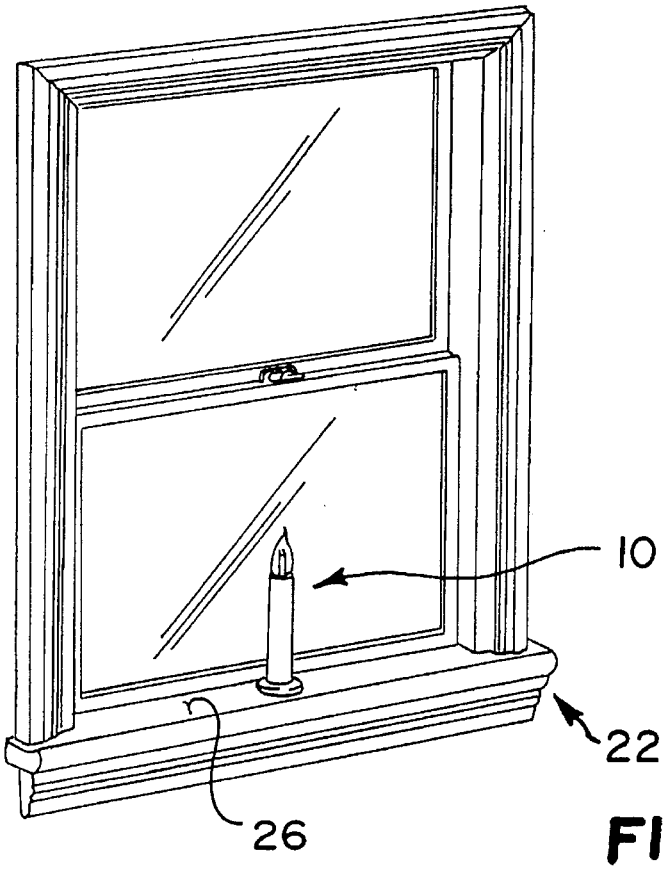
FIG. 1 is a perspective view of the window with the electric candle of the present invention installed thereon.
Figure 2:
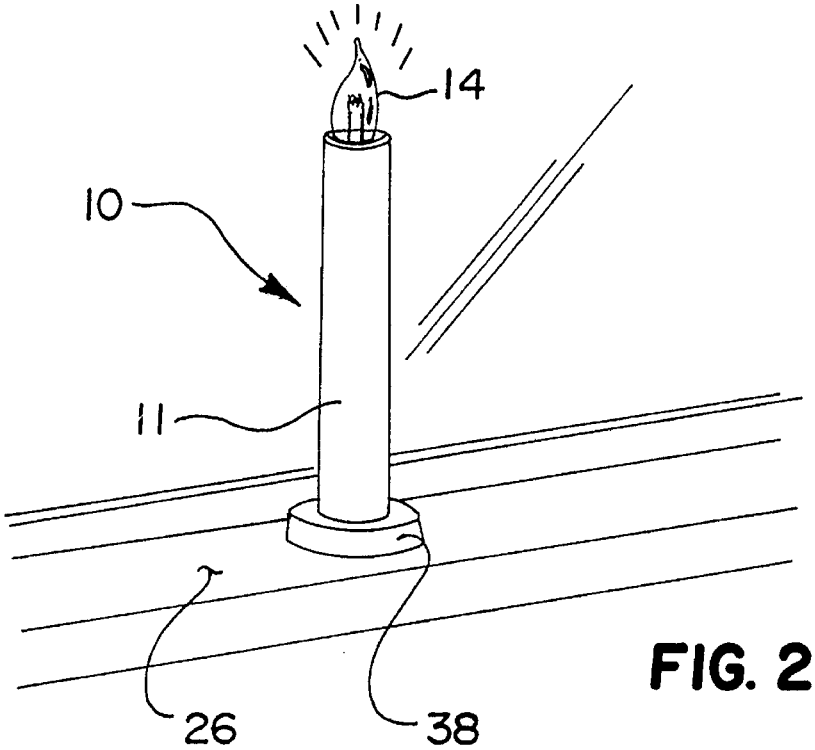
FIG. 2 is a perspective view of the electric candle of FIG. 1 with a decorative collar.
Figure 3:
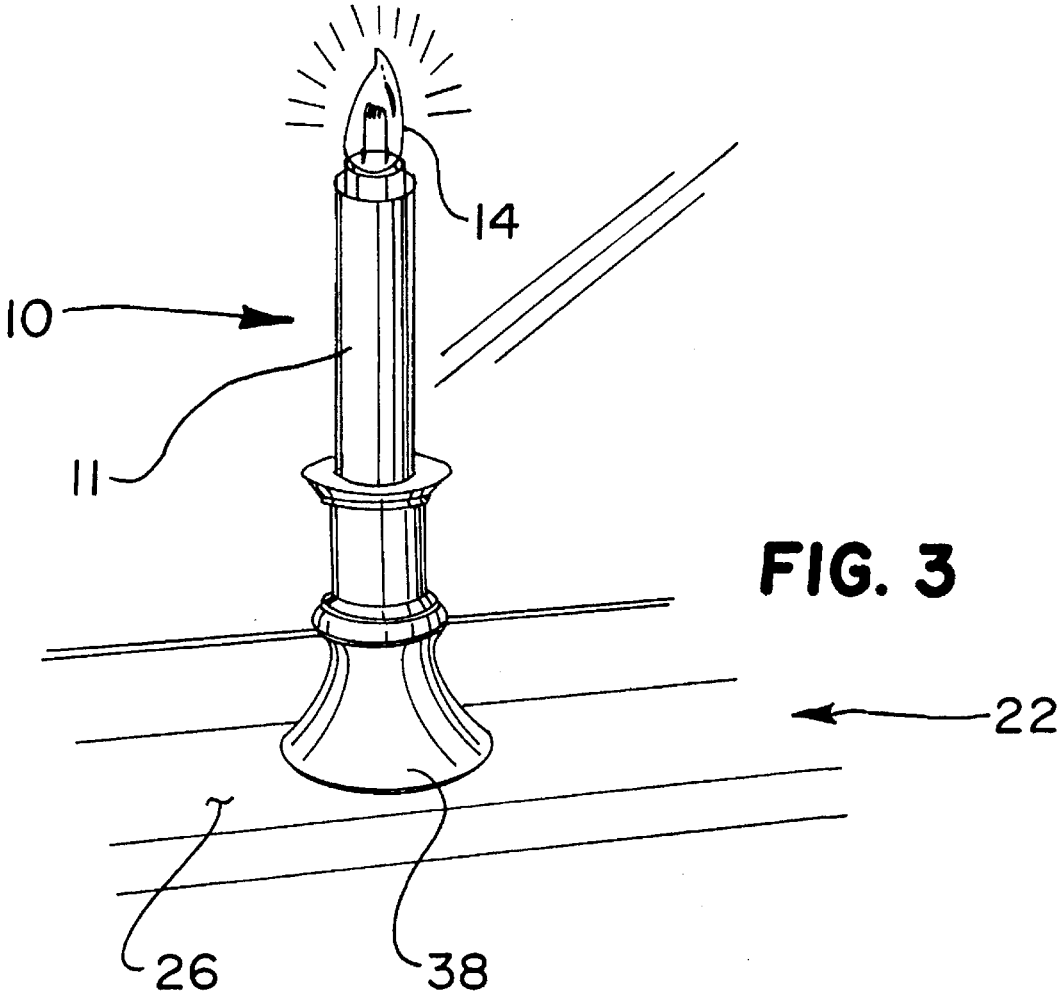
FIG. 3 is a perspective view of the electric candle of FIG. 1 with a decorative base.
Figure 5:
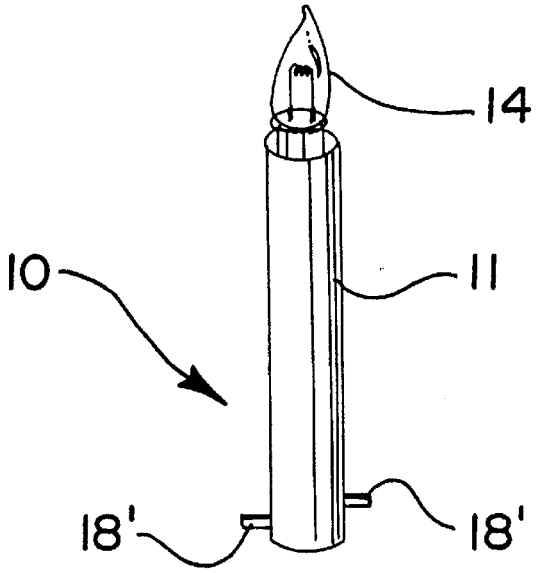
FIG. 5 is a perspective view of an alternate embodiment of the electric candle of the present invention, wherein prongs extend horizontally from the tubular body.
Figure 4:
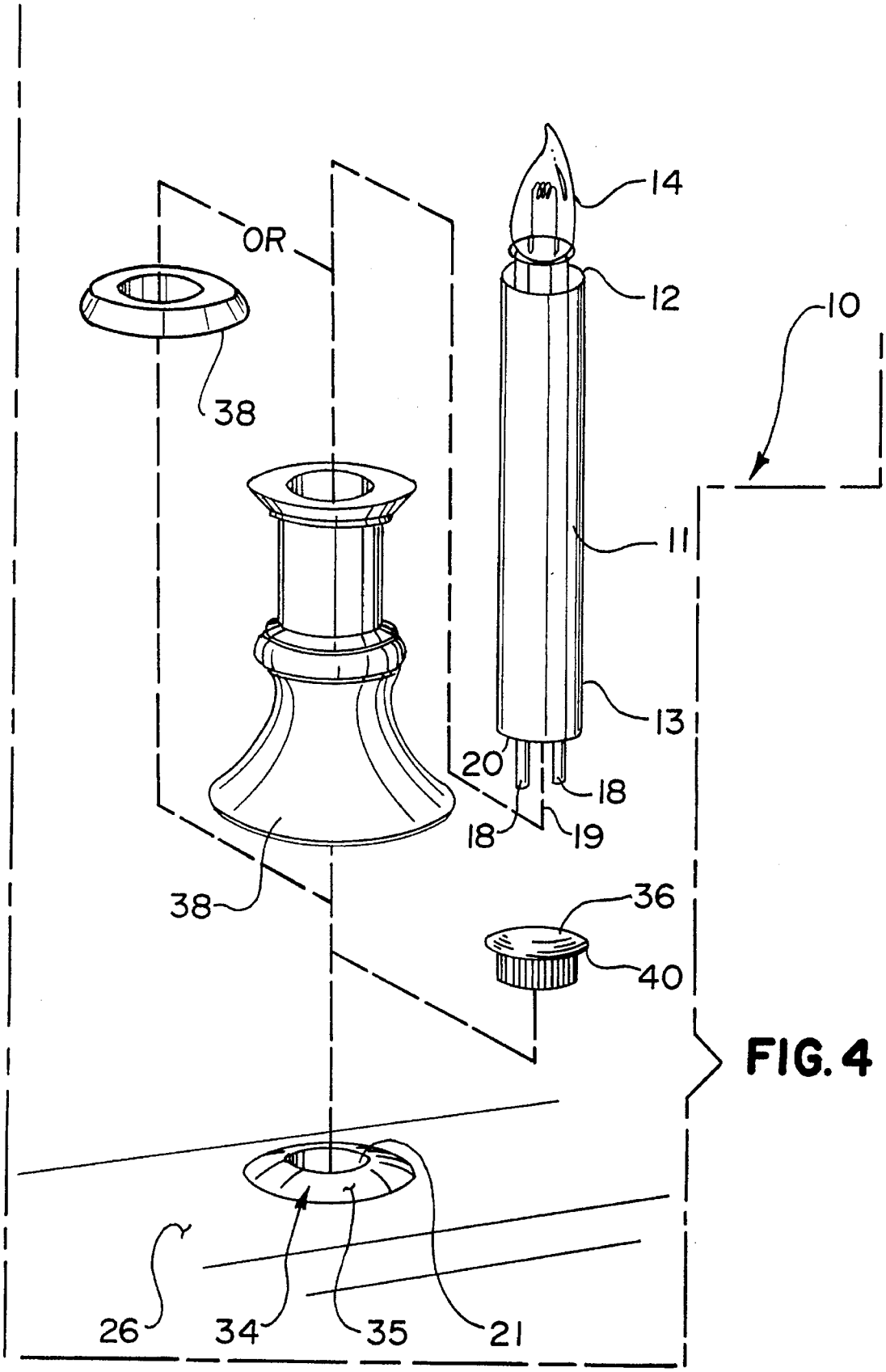
FIG. 4 is an exploded perspective view of the components of the electric candle of the present invention.
Figure 6:
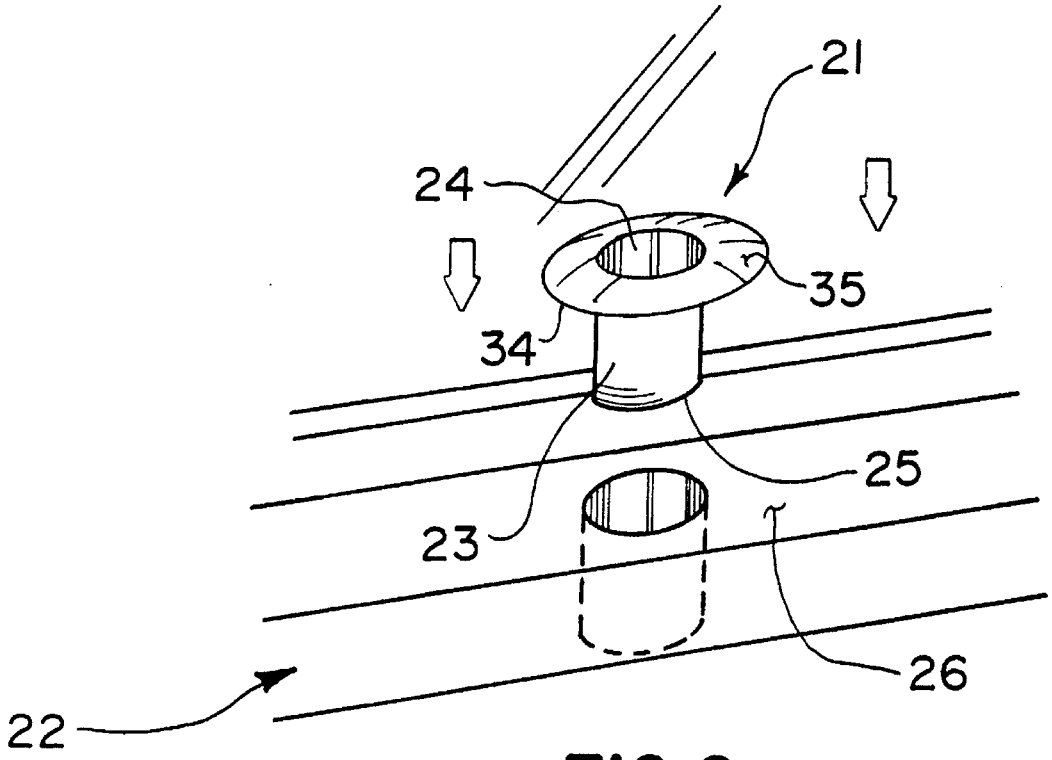
FIG. 6 is a perspective view of the socket of the present invention.
Figure 7:
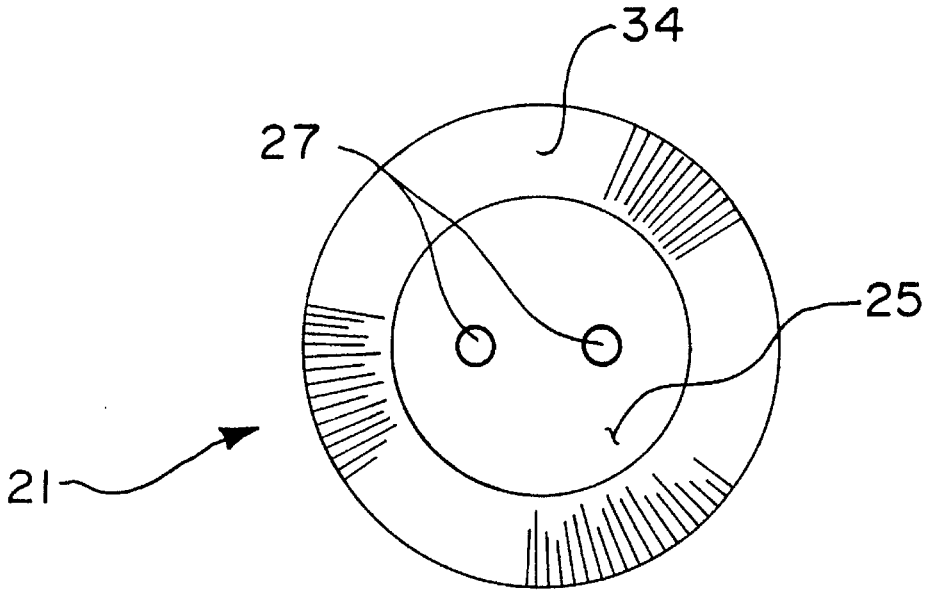
FIG. 7 is an upper view of the socket of FIG. 6.

Referring to FIGS. 1–18, a replaceable electric candle 10 includes a tubular body 11 having a top portion 12 and a lower portion 13. A low-voltage bulb 14 is removably secured to the top 12 by, for instance, turning the bulb 14 into the top portion 12. For this purpose, the top portion 12 is provided with a female threaded receptacle 15 for receiving a male threaded plug 16 on the bulb 14. A pair of brass electrodes (contact strips) 17 is provided within the plastic female threaded receptacle 15 for engagement and electrical contact with the conductive male threaded plug 16. The bulb 14 is preferably of a flame shape to create a complete candle appearance. A pair of prongs 18 are provided at the lower portion 13 of the tubular body 11.

As best shown in FIGS. 4, 8, 14 and 18, the prongs 18 can be spaced-apart vertical prongs (parallel with the longitudinal axis 19) secured to a lowermost surface 20 of the lower portion 13 of the tubular body 11.

In another embodiment, as best shown in FIGS. 5, 9, 10 and 15, prongs 18' may be horizontal prongs (perpendicular to the longitudinal axis 19) secured above the lowermost surface 20 and extending from the tubular body 11 in opposite directions. The prongs 18' are spaced 180° from each other in a horizontal plane and are also spaced vertically.

A socket 21 is installed in a window sill 22. The socket 21 has a hollow cylindrical body 23 with a receptacle end 24 and a contact end 25. The receptacle end 24 coincides with an upper surface 26 of the window sill 22, while the contact end 25 is spaced a length of the cylindrical body 23 from the upper surface 26 inside of the window sill 22. A pair of internal electric contacts 27 is provided at the contact end 25 of the cylindrical body 23.

Figure 8:
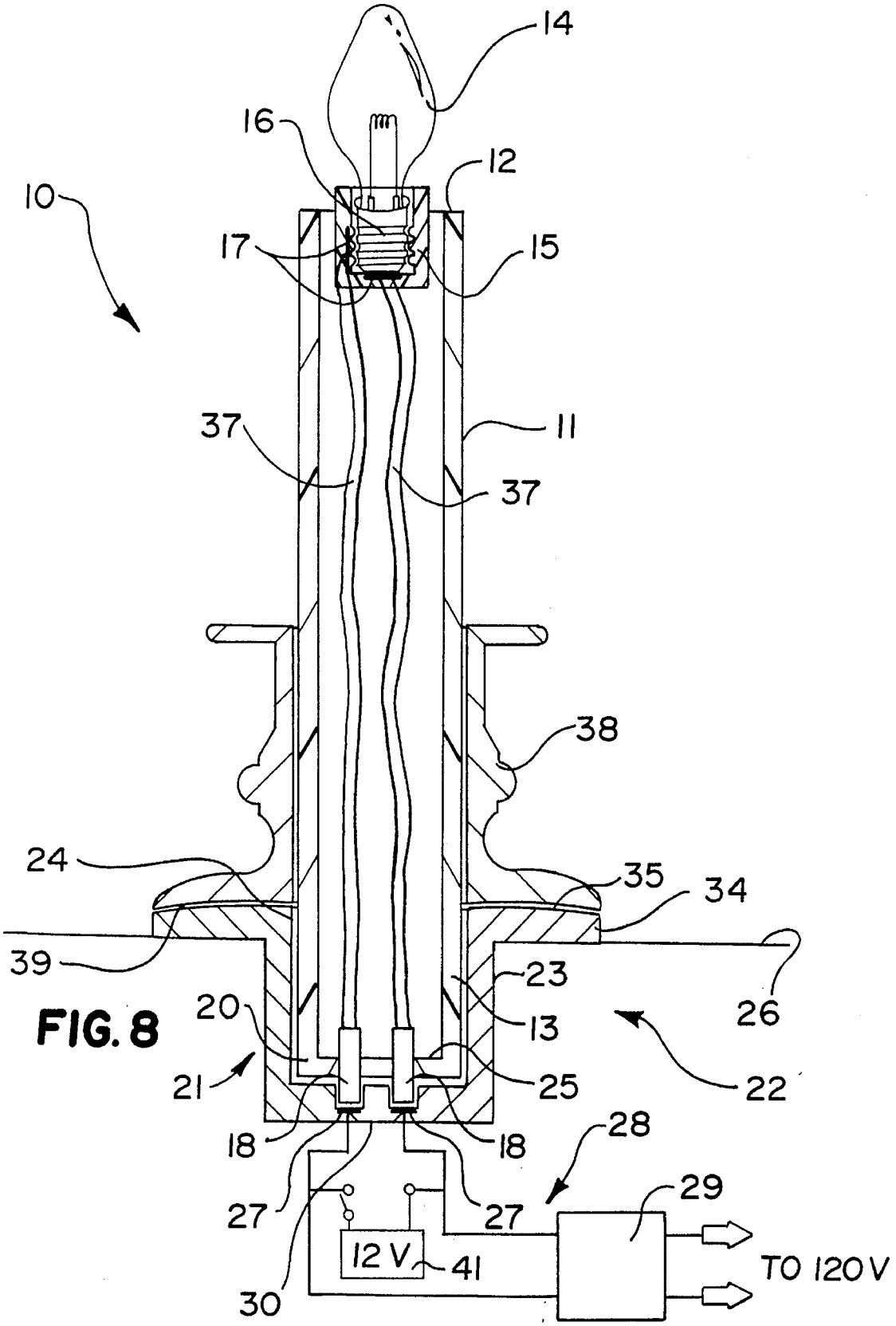
FIG. 8 is a longitudinal sectional view of the electric candle with parallel vertical prongs within the socket.
Figure 9:
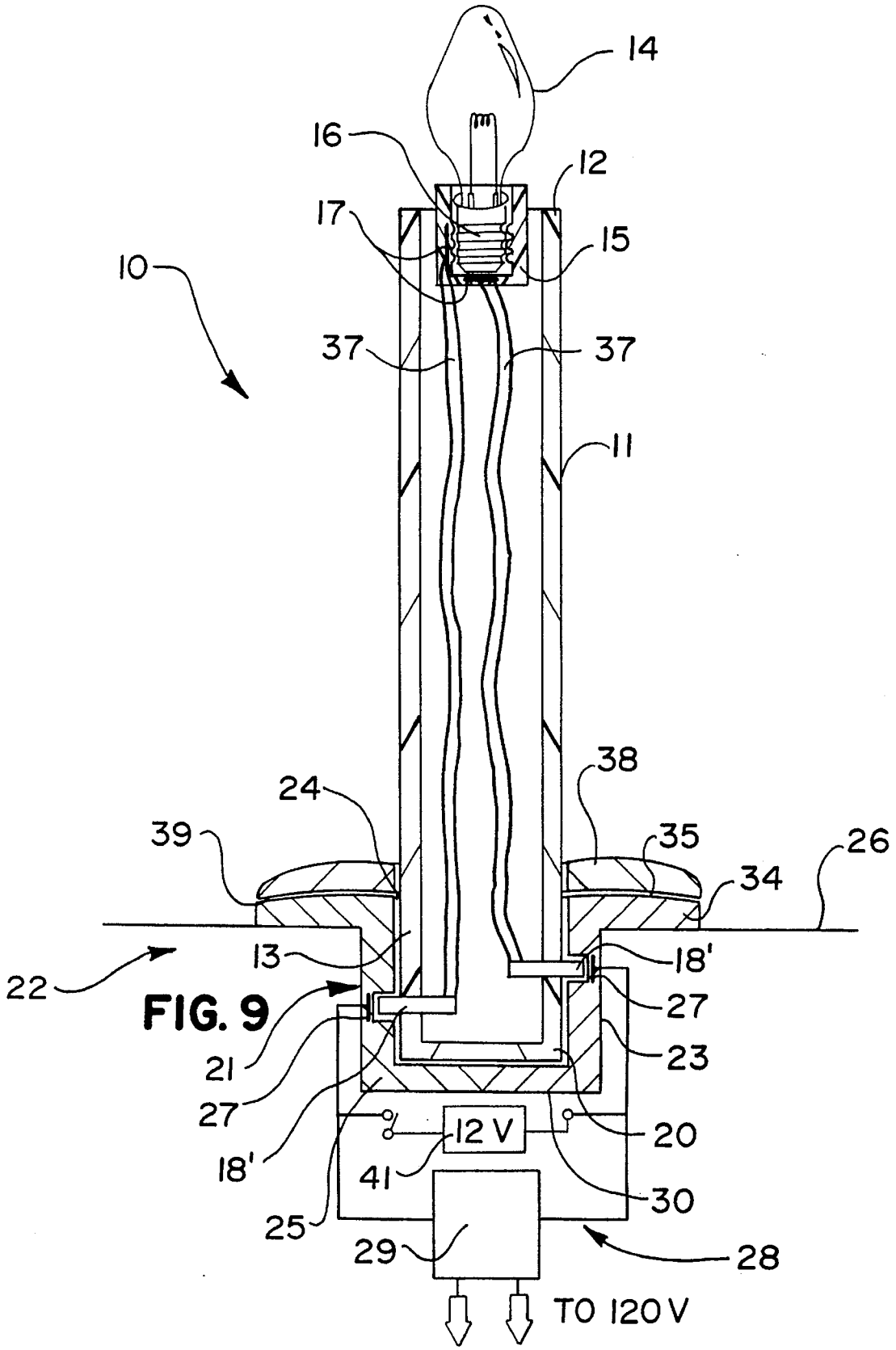
FIG. 9 is a further longitudinal sectional view, corresponding substantially to FIG. 8, but showing horizontal prongs within the socket.
Figure 10:
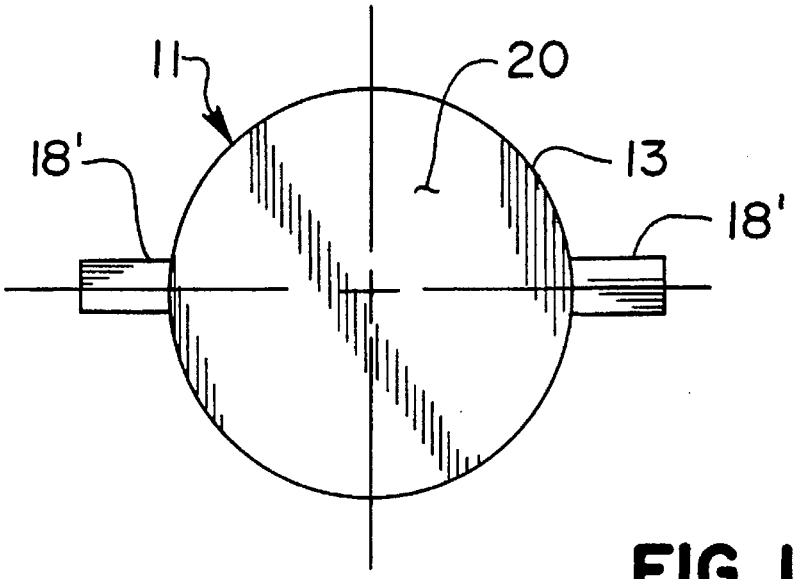
FIG. 10 is a bottom view of the electric candle of FIG. 9.
Figure 11:
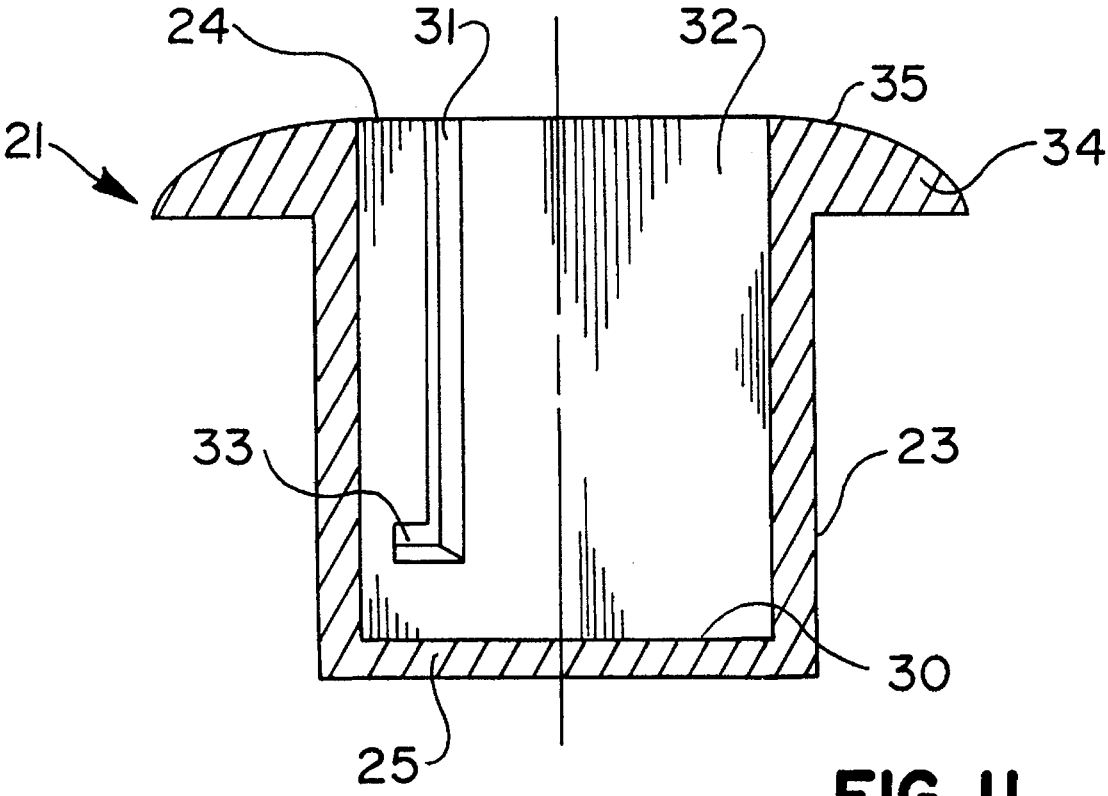
FIG. 11 is a cross-sectional view of the socket applicable for the electric candle of FIG. 9.
Figure 12:
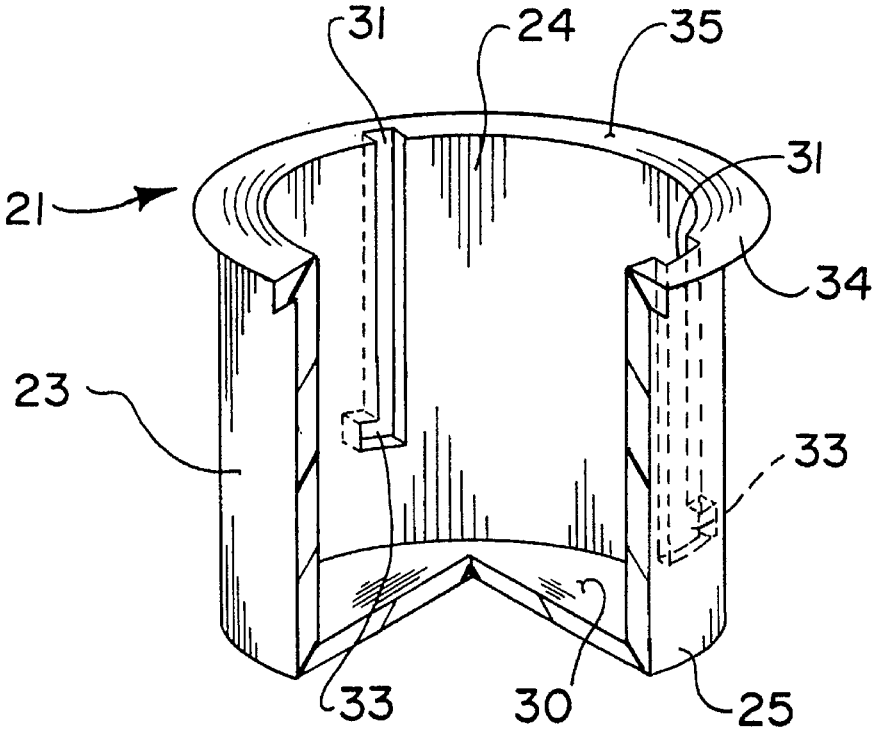
FIG. 12 is a partial cross-sectional view of the socket for receiving the electric candle of FIG. 9, showing vertical and horizontal slots.
Figure 13:
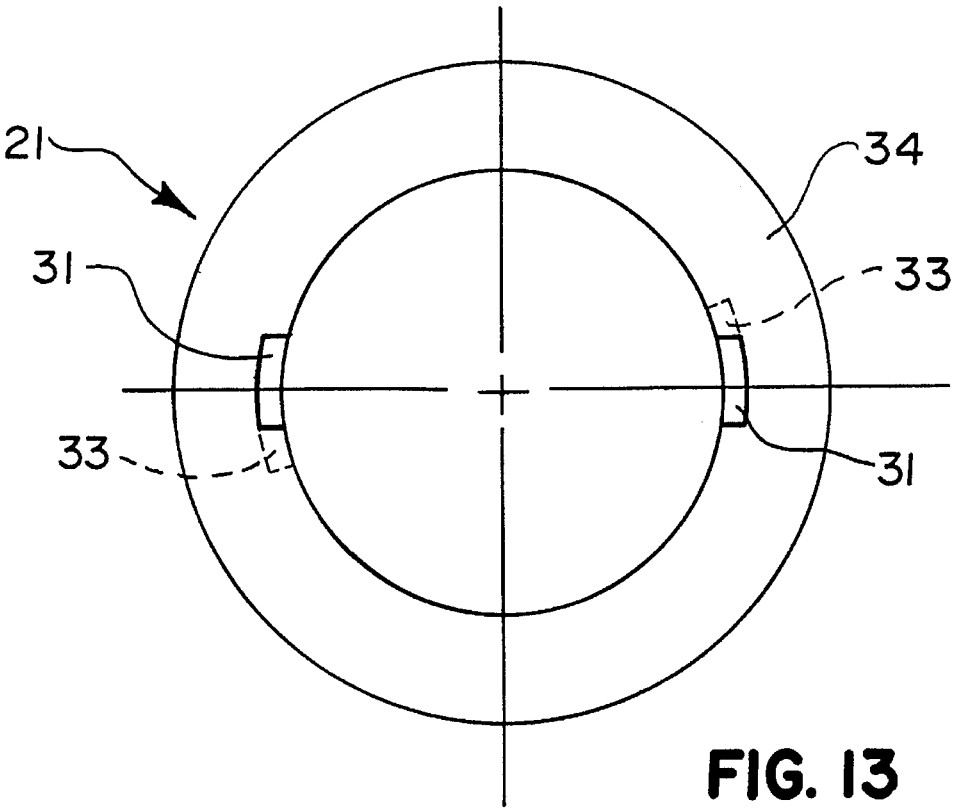
FIG. 13 is a top view of the socket of FIGS. 10 and 11.
Figure 14A:
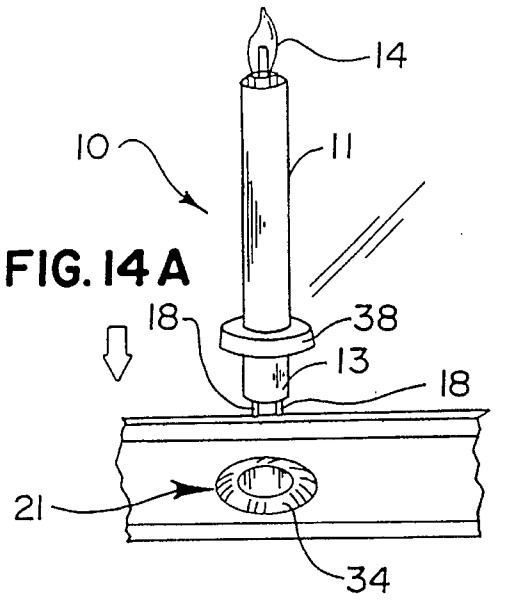
FIGS. 14A–14D show schematically a sequence of plugging and unplugging of the electric candle (of FIG. 8) with its parallel vertical prongs.
Figure 14B:
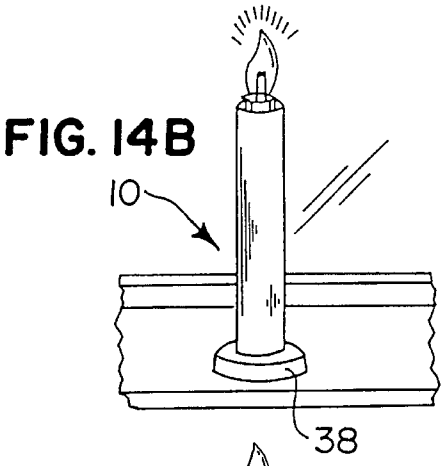
Figure 14C:
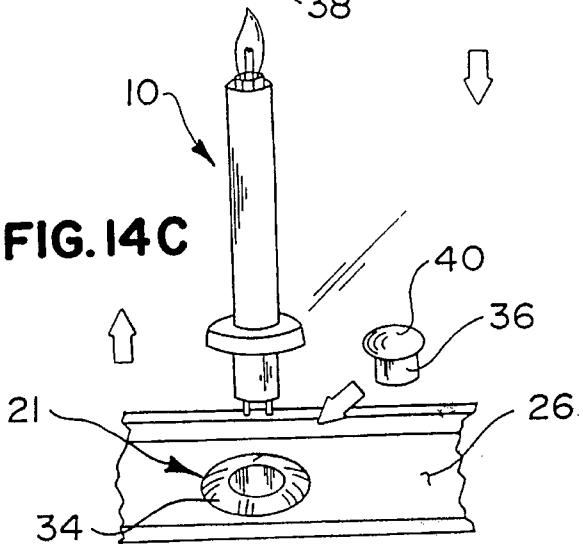
Figure 14D:
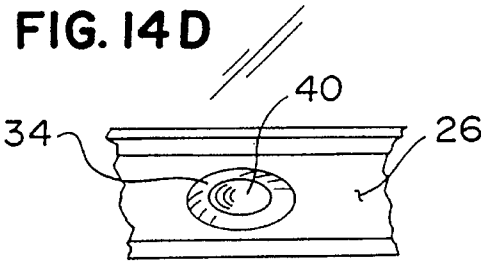
Figures 15A, 15B, 15C, 15D, 15E:
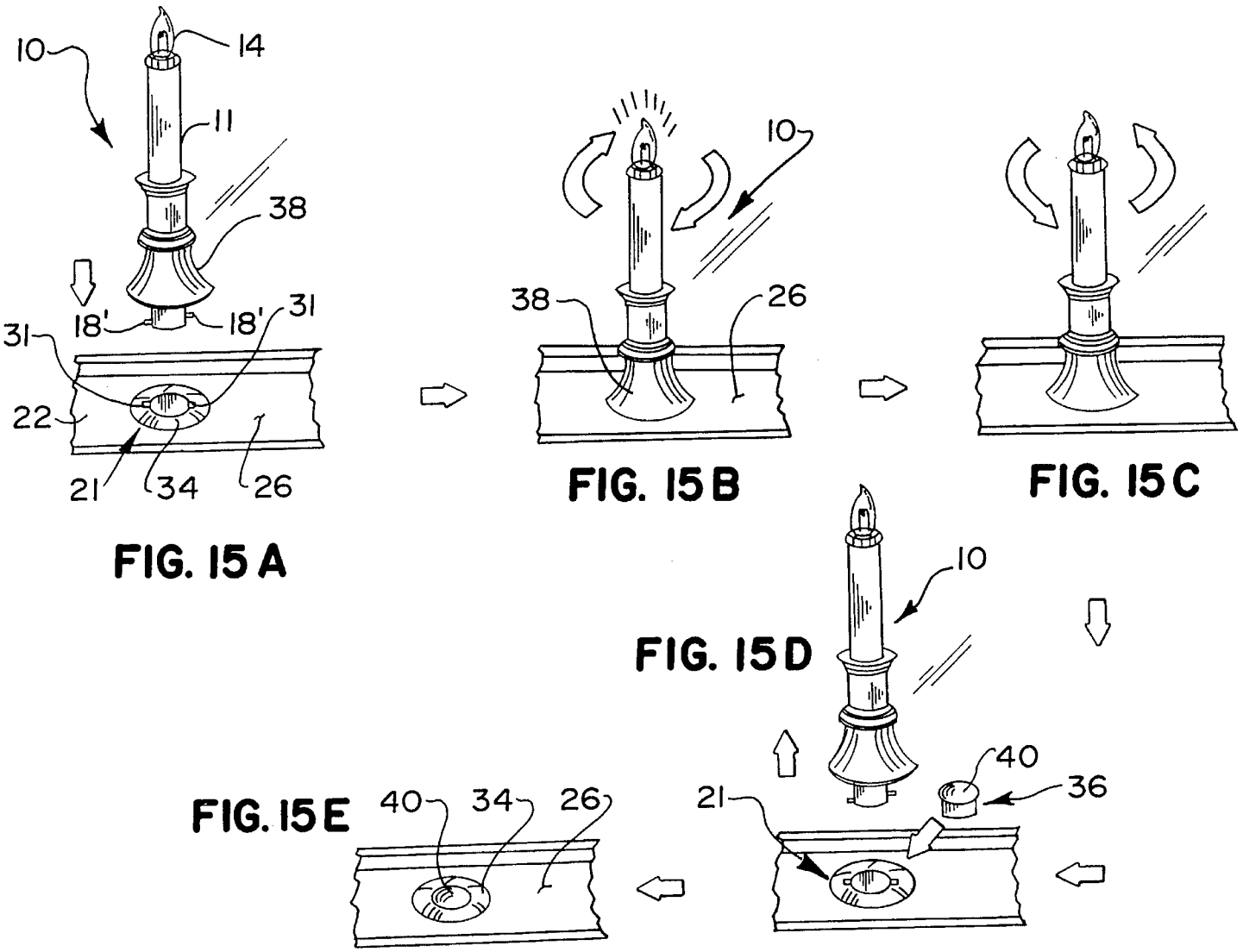
FIGS. 15A–15E is a further schematic sequence view, showing the plugging and unplugging of the electric candle (of FIG. 9) with its horizontal prongs.

As best shown in FIGS. 8 and 9, the electric contacts 27 are terminals of a parallel 12 V circuit 28 operated through a step-down transformer 29. The transformer 29, in the preferred embodiment, reduces the voltage 120 V to 12 V to supply power to the 12 V bulb 14. The transformer 29 may be a time-clock transformer, such that the time to automatically turn on and off the electric candle 10 can be set. As a back-up in the event of main power failure, a rechargeable battery 41 can be provided either in the electric circuit 28 or within the tubular body 11 (as best shown in FIGS. 8 and 9).

As best shown in FIGS. 4, 6–8 and 14, the socket 21 intended for receiving the electric candle 10 with the vertical prongs 18, has electric contacts 28 provided at the bottom 30 of the socket 21, such that the vertical prongs 18 can be inserted vertically into these electric contacts 28.

In another embodiment, best shown in FIGS. 9, 11–13 and 15, the socket 21 intended for receiving the electric candle 10 with horizontal prongs 18', has a pair of side vertical slots 31 formed on the internal surface 32 of the cylindrical body 23. The vertical slots 31 are spaced 180° from each other and have different lengths. Each of the vertical slots 31 terminates in a respective short horizontal slot 33. The internal electric contacts 27 in this case are placed at the horizontal slots 33.

As best shown in FIGS. 4, 6, 8, 9, 11, 12, 14A–14D and 15A–15E, the receptacle end 24 of the cylindrical body 23 of the socket 21 has flange 34 having an upper surface 35 rising above the upper surface of the window sill 22. Preferably, the flange 34 is integrally molded with the cylindrical body 23. The upper surface 35 can be colored as desired, preferably, similar to a protective cap 36 (discussed below).

As best shown in FIGS. 8 and 9, a conductive means (for example, a pair of wires 37) is placed within the tubular body 11. The wires 37 connect prongs 18 or 18' with the brass electrodes 17 secured within the female threaded receptacle 15. When the prongs 18 or 18' engage the electric contacts 27, electric power is supplied via the wires 37 from the step-down transformer 29 to the low-voltage bulb 14, thereby energizing the electric candle.

A decorative sleeve 38 is slipped over the tubular body 11 of the electric candle 10. The decorative sleeve 38 can be shaped as a decorative collar (as best shown in FIGS. 1, 2, 4, 9 and 14) or as a decorative base (as best shown in FIGS. 3, 4, 8 and 15). The decorative sleeve 38 can be adjusted along the length of the tubular body 11, and can be made of a metal or a plastic, and then flashed to have a metal-like appearance.

As best shown in FIGS. 8, 14A–14D and 18, when the electric candle 10 with the vertical prongs 18 is used, the lower portion 13 of the tubular body 11 is inserted into the receptacle end 24 of the socket 21 and is lowered down until the vertical prongs 18 completely engage with the electric contacts 27. When the electric candle 10 is to be removed, it is simply lifted out of the socket 21.

As best shown in FIGS. 9 and 15A–15E, when the horizontal prongs electric candle are used, the lower portion 13 is lowered down into the socket 21 such that the prongs 18' engage the vertical slots 31 and slide down therealong until the prongs 18' reach the horizontal slots 33 and then the candle 10 is turned approximately a quarter turn until the prongs 18' are received by the respective electric contacts 27. When the electric candle 10 is to be removed, it is turned by approximately a quarter turn in opposite direction until the prongs 18' reach the vertical slots 31 and the candle 10 is lifted out of the socket 21 (the prongs 18' slide along the vertical slots 31).

It will be appreciated by those skilled in the art, that the electric contacts 27 can be any typical contacts applicable for this purpose, and hence are not described in detail.

After the electric candle 10 has been removed, the protective cap 36, as best shown in FIGS. 4, 14A–14D and 15A–15E, is pressed over the socket 21. The protective cap 36 can be of any shape but, preferably, has an annular flange 40 surrounding the socket 21 and extending slightly above the upper surface 35 of the flange 34 of the socket 21. The cap 36 prevents anything from falling into the socket 21, serves safety reasons, and is also attractive.

When the electric candle 10 is being used, a bottom surface 39 of the decorative sleeve 38 leans against the upper surface 35 of the flange 34, and the bottom surface 39 and the upper surface 35 are shaped identically in order to provide a complete engagement therebetween. It will be appreciated by those skilled in the art, that if the bottom of the decorative sleeve is bigger than the flange 34, then only a portion of the bottom surface 39 which leans against the surface 35 is shaped identical to the surface 35.

The engagement of the prongs serves not only for electrical contact purposes; but also stabilizes the electric candle within the socket, thereby securing the electric candle to the window sill and preventing it from tipping over.

It will be appreciated by those skilled in the art that the socket 21, tubular body 11 and protective cap 36 are made of non-conductive materials such as plastic, or may include conductive material as long as it is properly insulated from the electrodes 17, electrical contacts 27, wires 37, prongs 18 or 18', and the metallic male threaded plug 16 of the bulb 14 for safe operation and avoiding short-circuiting.

The tubular body 11 can be made of different colored plastic or, optionally, a different colored plastic sleeve may be slipped over the candle, such as, for instance, an orange sleeve for Halloween.

Figure 16:
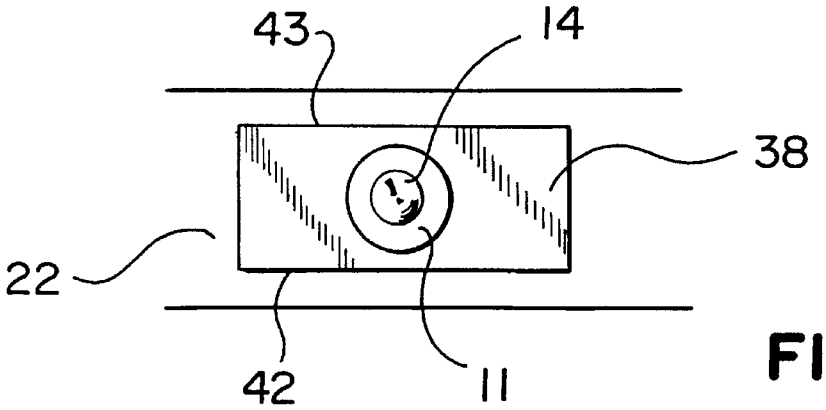
FIG. 16 is a top view of the candle of the present invention with the decorative base designed for narrow window sills.
Figure 17:
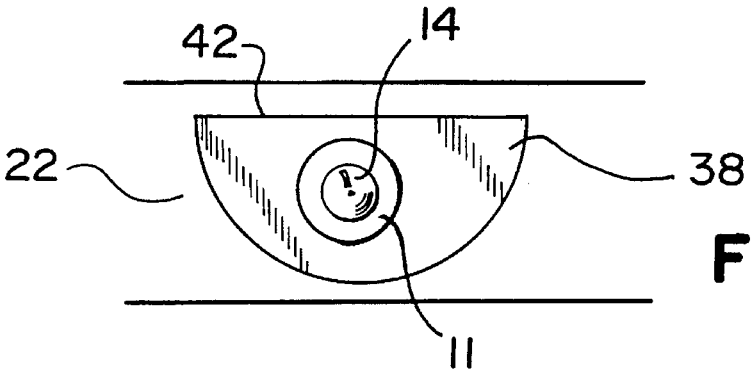
FIG. 17 is a top view of another decorative sleeve designed for narrow window sills.

If the candle is intended for being used at the windows having narrow sills for instance, Anderson™ crank-out windows, decorative sleeve 38 can be designed, as shown in FIGS. 16 and 17, to fit into the narrow window sill. The bottom of the decorative sleeve (the collar or the base) 38 will have either two parallel straight edges 42 and 43, or one straight edge 42. By eliminating circular edge of the decorative sleeve 38, the square of the bottom of the decorative sleeve, is reduced, thereby allowing the candle 10 with the decorative sleeve 38 to fit into even very narrow window sill.

Figure 18:
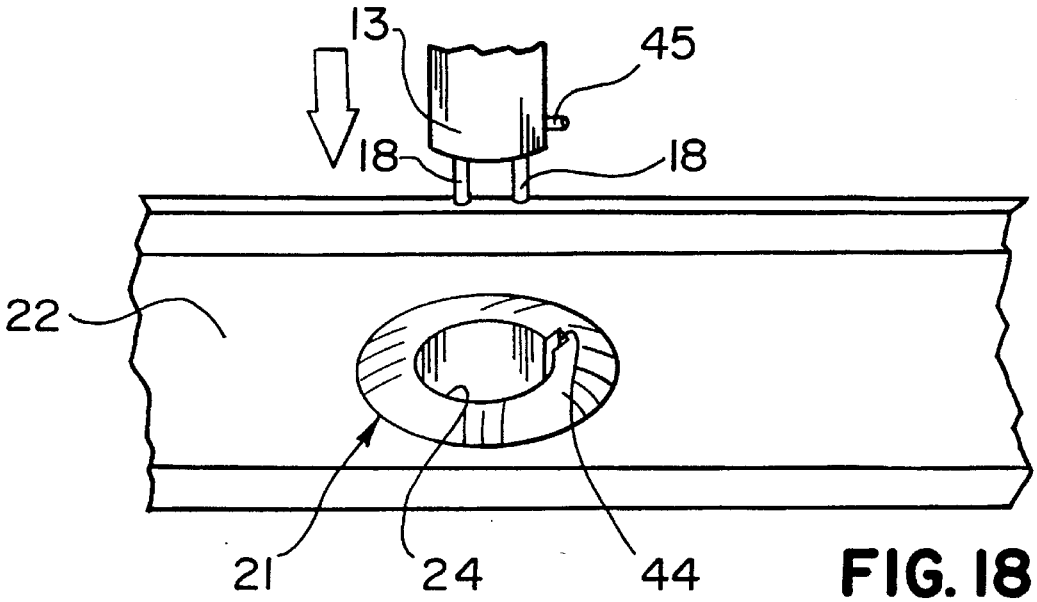
FIG. 18 shows the candle with vertical prongs having a "key way" for proper positioning of the candle in respect to the socket within the window sill.

As best shown in FIG. 18, the candle 10 with vertical prongs 18, may have a "key way" for facilitating to guide the candle's tubular body 11 into the socket 21 in proper orientation between the prongs 18 and the contacts 27. The "key way" may include a notch (or slot, or groove) 44 at the receptacle end 24 of the socket 21 and a protuberance (or a projection) 45 one the lower portion 13 of the tubular body 11. In order to insert the candle 10 into the socket 21, the protuberance 45 must be coincided with the notch 44, and then, the tubular body 11 slides down into the socket 21, thereby the prongs 18 are guided directly to the contacts 27.

It will be appreciated by those skilled in the art, that for the candles with the horizontal prongs 18', the vertical slots 31 serve as the "key way".

As described above, the replaceable electric candle of the present invention by its low voltage operation and the avoidance of surface wiring provides for a safe and convenient system that minimizes the chances of accident and injury.

Obviously, many modifications may be made without departing from the basic spirit of the present invention. Accordingly, it will be appreciated by those skilled in the art that within the scope of the appended claims, the inventions may be practiced other than has been specifically described herein.

I claim:

1. In combination with a low-voltage socket installed in a window sill, the window sill having an upper surface, wherein the socket comprises a hollow cylindrical body having a receptacle, coinciding with the upper surface of the window sill, and having a contact end, and wherein a pair of electric contacts are provided at the contact end, a replaceable electric candle, comprising:

a tubular body having a top portion and a lower portion spaced therefrom, a low-voltage bulb removably secured at the top of the tubular body, a pair of prongs secured to the lower portion of the tubular body, conductive means within the tubular body electrically connecting the pair of prongs with the low-voltage bulb, and a decorative sleeve slipped over the tubular body of the electric candle, the decorative sleeve having a bottom, wherein, when the electric candle is being used, the bottom of the decorative sleeve leans against the receptacle end of the cylindrical body of the socket, and the lower portion of the tubular body of the electric candle is received within the cylindrical body of the socket, such that the pair of prongs engages said pair of the electrical contacts, thereby supplying electric power to the low-voltage bulb and mechanically stabilizing the electric candle within the socket, and wherein, when not being used, the electric candle is lifted out of the socket.

2. The electric candle of claim 1, further provided with a protective cap, such that when the electric candle is lifted out of the socket, the protective cap is pressed over the socket.

3. The electric candle of claim 1, wherein said pair of prongs includes spaced-apart prongs secured to a lowermost surface of the lower part of the tubular body substantially parallel with a longitudinal axis of the tubular body of the electric candle.

4. The electric candle of claim 1, wherein said pair of prongs includes prongs horizontally extending from the tubular body of the electric candle, above a lowermost surface of the tubular body of the electric candle, the prongs being spaced 180° from each other.

5. The electric candle of claim 4, wherein said prongs are spaced vertically.

6. The electric candle of claim 4, wherein the cylindrical body of the socket includes a pair of internal side vertical slots spaced 180° from each other, each terminating in a respective horizontal slot at the contact end, each of said respective horizontal slots accommodating a respective one of said electric contacts, the horizontal slots being spaced vertically, such that when the electric candle is to be inserted into the socket, the prongs are moved down along said vertical slots until they engage said horizontal slots and thereafter the electric candle is rotated, each of said pair of prongs within a respective horizontal slot approximately a quarter turn until each prong engages a respective one of said electric contacts.

7. The electric candle of claim 1, wherein the receptacle end of the cylindrical body of the socket includes an annular flange having an upper surface rising above the upper surface of the window sill, and wherein the bottom surface of the decorative sleeve is shaped similar to the upper surface of said annular flange.

8. The electric candle of claim 1, wherein the decorative sleeve is made of brass.

9. The electric candle of claim 1, wherein the decorative sleeve is made of a plastic.

10. The electric candle of claim 9, wherein the plastic is flashed to have a metal-like appearance.

11. The electric candle of claim 1, wherein the decorative sleeve is a decorative collar.

12. The electric candle of claim 1, wherein the decorative sleeve is a decorative base.

13. The electric candle of claim 1, wherein the decorative sleeve can be height adjusted along the tubular body.

14. The electric candle of claim 1, further comprising a 12 V electric candle.

15. The electric candle of claim 1, wherein said electric contacts are terminals of a parallel 12 V circuit operated through a step-down transformer.

16. The electric candle of claim 15, further including a back-up rechargeable battery.

17. The electric candle of claim 1, wherein said window sill is a narrow window sill, and wherein the bottom of the decorative sleeve is shaped and sized for said narrow window sill.

18. The electric candle of claim 1, further comprising a key way facilitating a proper positioning of the tubular body within the socket.

19. In combination with a low-voltage socket installed in a window sill, the window sill having an upper surface, wherein the socket comprises a hollow cylindrical body having a receptacle, coinciding with the upper surface of the window sill, and having a contact end, and wherein a pair of electric contacts are provided at the contact end, said electric contacts being terminals of a parallel 12 V circuit operated through a step-down transformer, a replaceable electric candle, comprising:

a tubular body having a top portion and a lower portion spaced therefrom, a low-voltage bulb removably secured at the top portion of the tubular body, a pair of prongs secured to the lower portion of the tubular body, conductive means within the tubular body electrically connecting the pair of prongs with the low-voltage bulb, a plastic decorative sleeve slipped over the tubular body of the electric candle and being height adjusted thereal-long, and a protective cap;

wherein, when the electric candle is being used, the bottom of the decorative sleeve leans against the receptacle end of the cylindrical body of the socket, and the lower portion of the tubular body of the electric candle is received within the cylindrical body of the socket, such that said pair of prongs engages said pair of the electric contacts, thereby supplying electric power to the low-voltage bulb and mechanically stabilizing the electric candle within the socket, and wherein, when not being used, the electric candle is lifted out of the socket, and the protective cap is pressed over the socket;

wherein said pair of the prongs includes spaced-apart prongs secured to a lowermost surface of the lower part of the tubular body substantially parallel with a longitudinal axis of the tubular body of the electric candle;

wherein the receptacle end of the cylindrical body of the socket includes an annular flange having an upper surface rising above the upper surface of the window sill, and wherein a bottom surface of the decorative sleeve is shaped similar to the upper surface of said annular flange.

20. The electric candle of claim 19, wherein the plastic decorative sleeve is flashed to have a metal-like appearance.

21. The electric candle of claim 19, further including a back-up rechargeable battery.

22. In combination with a low-voltage socket installed in a window sill, the window sill having an upper surfaces, wherein the socket comprises a hollow cylindrical body having a receptacle, coinciding with the upper surface of the window sill, and having a contact end, and wherein a pair of electric contacts are provided at the contact end, said electric contacts being terminals of a parallel 12 V circuit operated through a step-down transformer, a replaceable electric candle, comprising:

a tubular body having a top portion and a lower portion spaced therefrom, a low-voltage bulb removably secured at the top portion of the tubular body, a pair of prongs secured to the lower portion of the tubular body, conductive means within the tubular body electrically connecting the pair of prongs with the low-voltage bulb, a plastic decorative sleeve slipped over the tubular body of the electric candle and being height adjusted thereal-long, the decorative sleeve having a bottom, and a protective cap;

wherein, when the electric candle is being used, the bottom of the decorative sleeve leans against the receptacle end of the cylindrical body of the socket, and the lower portion of the tubular body of the electric candle is received within the cylindrical body of the socket, such that said pair of prongs engages said pair of the electrical contacts, thereby supplying electric power to the low-voltage bulb and mechanically stabilizing the electric candle within the socket, and wherein, when not being used, the electric candle is lifted out of the socket, and the protective cap is pressed over the socket;

wherein, said pair of prongs includes prongs horizontally extending from the tubular body of the electric candle above a lowermost surface of the tubular body of the electric candle, the prongs being spaced 180° from each other horizontally, and said prongs further being spaced vertically;

wherein the cylindrical body of the socket includes a pair of internal side vertical slots spaced 180° from each other, and each terminating in a respective horizontal slot at the contact end, each of said respective horizontal slots accommodating a respective one of said electric contacts, the horizontal slots being spaced vertically, such that when the electric candle is to be inserted into the socket, the prongs are moved down along said vertical slots until they engage said horizontal slots and thereafter the electric candle is rotated, each of said pair of prongs within a respective horizontal slot approximately a quarter turn until each prong engages a respective one of said electric contacts;

wherein the receptacle end of the cylindrical body of the socket includes an annular flange having an upper surface rising above the upper surface of the window sill, and wherein the bottom surface of the decorative sleeve is shaped similar to the upper surface of said annular flange.

23. The electric candle of claim 22, wherein the plastic decorative sleeve is flashed to have a metal-like appearance.

24. The electric candle of claim 22, further including a back-up rechargeable battery.

* * * * *